US008451611B2

(12) United States Patent
Nakagami et al.

(10) Patent No.: US 8,451,611 B2
(45) Date of Patent: May 28, 2013

(54) INTEGRATED-INVERTER ELECTRIC COMPRESSOR

(75) Inventors: Takashi Nakagami, Tokyo (JP); Hiroyuki Kamitani, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 315 days.

(21) Appl. No.: 12/904,464

(22) Filed: Oct. 14, 2010

(65) Prior Publication Data

US 2011/0189035 A1 Aug. 4, 2011

(30) Foreign Application Priority Data

Feb. 1, 2010 (JP) ..... 2010-020206

(51) Int. Cl.
*F25B 31/00* (2006.01)
*F01C 1/02* (2006.01)
*H05K 7/20* (2006.01)

(52) U.S. Cl.
USPC ..... 361/714; 361/679.46; 361/679.54; 361/704; 361/715; 165/104.33; 165/185; 417/410.1; 417/410.5

(58) Field of Classification Search
USPC ..... 361/679.46–679.54, 688, 689, 698–704, 361/710–717, 736, 752; 62/3.7, 259.2, 228.4, 62/113, 505; 174/16.3, 252; 363/123, 146, 363/147; 310/51, 52, 54, 71; 417/45, 366, 417/371, 357, 410.1, 410.5, 423.14, 321; 257/714; 165/80.2–80.5, 104.33, 185
See application file for complete search history.

(56) References Cited

U.S. PATENT DOCUMENTS 6,198,183 B1 * 3/2001 Baeumel et al. ..... 310/52
6,672,101 B2 * 1/2004 Gennami et al. ..... 62/469
6,808,372 B2 * 10/2004 Makino et al. ..... 417/410.5
7,122,928 B2 * 10/2006 Shindo ..... 310/89
7,207,187 B2 * 4/2007 Funahashi et al. ..... 62/228.4

(Continued)

FOREIGN PATENT DOCUMENTS

EP 1382849 A2 1/2004
EP 1450044 A2 8/2004

(Continued)

OTHER PUBLICATIONS

European Search Report dated Sep. 6, 2011, issued in corresponding European Patent Application No. 10187327.1.

*Primary Examiner* — Michail V Datskovskiy
(74) *Attorney, Agent, or Firm* — Westerman, Hattori, Daniels & Adrian, LLP

(57) ABSTRACT

An object is to achieve a compact design by using a dead space in an inverter box effectively, to improve cooling properties of heat-generating electrical components disposed on a control circuit board of an inverter, and to increase flexibility of wiring layout. In an inverter box provided at a periphery of a housing, a heat-dissipating flat portion that is parallel to a control circuit board of an inverter is formed, and electrical components are disposed in a space between the heat-dissipating flat portion and the control circuit board. Preferably, the electrical components are installed so that the back faces thereof abut against the heat-dissipating flat portion either directly or via a heat-conducting member. More preferably, faces of the electrical components on the board side abut against the control circuit board.

6 Claims, 9 Drawing Sheets

U.S. PATENT DOCUMENTS

| | | | | |
|---|---|---|---|---|
| 7,473,079 | B2 * | 1/2009 | Ogawa et al. | 417/410.5 |
| 7,473,080 | B2 * | 1/2009 | Kawada et al. | 417/423.14 |
| 8,162,626 | B2 * | 4/2012 | Fukasaku et al. | 417/410.1 |
| 2004/0145860 | A1 * | 7/2004 | Shindo | 361/622 |
| 2004/0197213 | A1 * | 10/2004 | Takemoto | 417/410.1 |
| 2005/0129557 | A1 * | 6/2005 | Makino et al. | 418/55.6 |
| 2008/0095646 | A1 * | 4/2008 | Nishii et al. | 417/411 |
| 2008/0181791 | A1 * | 7/2008 | Iguchi et al. | 417/45 |
| 2009/0010786 | A1 * | 1/2009 | Koide et al. | 417/423.14 |
| 2010/0183458 | A1 * | 7/2010 | Itabashi et al. | 417/410.5 |

FOREIGN PATENT DOCUMENTS

| | | | | |
|---|---|---|---|---|
| EP | 1978253 | A1 | | 10/2008 |
| JP | 02003153552 | A | * | 5/2003 |
| JP | 02009144603 | A | * | 7/2003 |
| JP | 02003262187 | A | * | 9/2003 |
| JP | 02005344689 | A | * | 12/2005 |
| JP | 3818163 | B2 | | 9/2006 |
| JP | 2008-252962 | A | | 10/2008 |
| JP | 2008-267211 | A | | 11/2008 |
| JP | 2010-093202 | A | | 4/2010 |

* cited by examiner

INTEGRATED-INVERTER ELECTRIC COMPRESSOR

BACKGROUND OF THE INVENTION

1. Field of the Invention

The present invention relates to an integrated-inverter electric compressor that is constructed by installing an inverter in an inverter box provided at a periphery of a housing and that is particularly suitable for use in a vehicle air conditioner.

This application is based on Japanese Patent Application No. 2010-020206, the content of which is incorporated herein by reference.

2. Description of Related Art

Recently, in addition to automobiles that run on internal combustion engines, development and market introduction of vehicles that run on electric power, such as electric vehicles, hybrid vehicles, and fuel-cell vehicles, are advancing rapidly. In many air conditioners for such vehicles that run on electric power, electric compressors driven by electric motors that operate using electric power are used as compressors that compress refrigerant and feed the compressed refrigerant.

Also with air conditioners of automobiles that run on internal combustion engines, there exists a type in which, instead of a compressor that is driven via an electromagnetic clutch by the internal combustion engine for running, an electric compressor is used in order to avoid degradation of driveability caused by engagement and disengagement of the electromagnetic clutch.

As such an electric compressor, a hermetic electric compressor in which a compressor and an electric motor are provided together inside a housing is employed. In particular, an electric compressor in which electric power supplied from a power source is supplied to the electric motor via an inverter and the rotation speed of the compressor can be controlled to vary in accordance with the air conditioning load is often employed.

According to some proposals that have hitherto been made, in such an electric compressor driven via an inverter, a control circuit board or the like constituting the inverter is accommodated in an inverter box formed integrally at the periphery of a housing of the electric compressor, thereby integrating the inverter with the electric compressor, and electrical components such as a smoothing capacitor that suppresses ripple of a current supplied to the control circuit board or the like, a switching element, and a reactor are accommodated in the inverter box (e.g., see Japanese Unexamined Patent Application, Publication No. 2008-252962 and the Publication of Japanese Patent No. 3818163).

In the integrated electric compressor according to Japanese Unexamined Patent Application, Publication No. 2008-252962, as disclosed in FIGS. 1, 3, and 4 of the document, in an inverter box, a capacitor is disposed vertically at a position not overlapping a control circuit board of an inverter, and the capacitor is electrically connected to the control circuit board via a busbar.

In the integrated electric compressor according to the Publication of Japanese Patent No. 3818163, as disclosed in FIGS. 7 and 8 of the document, a control circuit board of an inverter is installed in an inverter box formed integrally at the periphery of a housing, and electrical components are disposed in a dead space formed between the bottom face of the control circuit board and the periphery of the housing constituting the bottom face of the inverter box.

BRIEF SUMMARY OF THE INVENTION

However, in the integrated electric compressor according to Japanese Unexamined Patent Application, Publication No. 2008-252962, in order to dispose the capacitor at a position not overlapping the control circuit board of the inverter, the inverter box needs an extra overhang, which has resulted in an increased size of the integrated electric compressor.

Furthermore, since the capacitor is remote from the switching element or the like disposed on the control circuit board, inevitably requiring a long busbar for interconnection, the effect of the capacitor is reduced by resistive and inductive components of the busbar. Therefore, the capacitance of the capacitor must be large enough in view of the reduced effectiveness, which has resulted in a further increase in the size of the integrated electric compressor.

On the other hand, in the integrated electric compressor according to the Publication of Japanese Patent No. 3818163, when the outer diameter of the motor is small, in some cases, it is not possible to accommodate a relatively large electrical component, such as a capacitor, in a dead space formed between the bottom face of the control circuit board and the periphery of the housing constituting the bottom face of the inverter box. In such cases, similarly to the case of Japanese Unexamined Patent Application, Publication No. 2008-252962, the inverter box needs an extra overhang.

Furthermore, in order to allow connection of a power cable from outside to the inverter via a shortest distance, the lead-out direction of a connecting part for the power cable is restricted to directions perpendicular to the direction of the main shaft of the integrated electric compressor, resulting in unsatisfactory flexibility of wiring layout. In order to set the lead-out direction of the cable connecting part along the direction of the main shaft, a busbar is needed for connection, which reduces the effect of the capacitor.

Furthermore, in both cases of Japanese Unexamined Patent Application, Publication No. 2008-252962 and the Publication of Japanese Patent No. 3818163, it is not possible to actively dissipate heat from and thereby cool electrical components that tend to generate heat (heat-generating elements), such as the capacitor. Therefore, the internal volume of the inverter box and the capacitance of the capacitor inevitably increase in order to maintain adequate performance against overheating. This has also inhibited compact design.

The present invention has been made in view of the situation described above, and it is an object thereof to provide an integrated-inverter electric compressor in which a dead space in an inverter box is used effectively to achieve a compact design, and it is possible to improve cooling properties of heat-generating electrical components disposed on a control circuit board of an inverter, to increase flexibility of wiring layout, and to improve anti-vibration properties of electrical components.

In order to achieve the above object, the present invention employs the following solutions.

An integrated-inverter electric compressor according to an aspect of the present invention includes an inverter box provided at a periphery of a housing, an inverter having a control circuit board and accommodated in the inverter box, and an electrical component mounted on one face of the control circuit board and constituting the inverter, wherein a heat-dissipating flat portion that constitutes an outer wall of the housing and that is parallel to the control circuit board of the inverter is formed in the inverter box, and the electrical component is disposed in a space between the heat-dissipating flat portion and the control circuit board.

According to the aspect of the present invention, the electrical component disposed on a face of the control circuit board and constituting the inverter is disposed in the space between the control circuit board and the heat-dissipating flat portion formed parallel to the control circuit board on the outer wall of the housing. Accordingly, a dead space in the inverter box is used effectively, and the integrated-inverter electric compressor becomes compact.

Furthermore, since the electrical component is disposed in proximity to the heat-dissipating flat portion, heat from the electrical component is dissipated to the heat-dissipating flat portion, so that cooling properties are improved. In addition, since the electrical component to which a power cable from outside is connected can be disposed at flexible positions on the control circuit board, flexibility of wiring layout is increased.

In the above aspect of the present invention, preferably, the electrical component is installed so that a back face thereof abuts against the heat-dissipating flat portion either directly or via a heat-conducting member.

In this case, since heat generated by the electrical component is dissipated directly to the heat-dissipating flat portion, the electrical component can be cooled efficiently. Furthermore, since there is no space between the electrical component and the heat-dissipating flat portion, it is possible to reduce the height of the inverter box. In addition, owing to the good cooling efficiency of the electrical component, it becomes possible to reduce the internal volume of the inverter box and the capacitance of a capacitor, which considerably contributes to compact design of the integrated-inverter electric compressor as a whole.

Furthermore, in the above aspect of the present invention, preferably, the electrical component is installed so that a face thereof on a board side abuts against the control circuit board.

In this case, since there is no space between the electrical component and the control circuit board, it is possible to reduce the height of the inverter box. In addition, owing to the good cooling efficiency of the electrical component, it becomes possible to reduce the internal volume of the inverter box and the capacitance of a capacitor, which considerably contributes to compact design of the integrated-inverter electric compressor as a whole.

In the above aspect of the present invention, a plurality of the electrical components having different heights may be mounted on the control circuit board at different heights so that back faces of the individual electrical components abut against the heat-dissipating flat portion either directly or via a heat-conducting member.

In this case, heat from the individual electrical components is dissipated to the heat-dissipating flat portion uniformly and effectively, so that cooling properties of the individual electrical components are improved.

Furthermore, in the above configuration, of the plurality of the electrical components, an electrical component with a greater height may have an extension integrally formed therewith, the extension extending toward an electrical component with a smaller height and overlapping the electrical component to press the electrical component toward the heat-dissipating flat portion.

In this case, the electrical component with the smaller height is pressed toward the heat-dissipating flat portion by the electrical component with the greater height, so that heat generated from the electrical component with the smaller height is dissipated efficiently to the heat-dissipating flat portion.

In the one aspect of the present invention, preferably, a cover that covers at least one of the electrical components is provided, and the cover is fastened to the heat-dissipating flat portion so that the electrical component abuts against the heat-dissipating flat portion.

In this case, since the individual electrical components are covered by the cover and pressed toward the heat-dissipating flat portion, cooling properties of the individual electrical components are improved, and resonance of the individual electrical components with vehicle vibration or the like is suppressed, resulting in improved anti-vibration properties of the individual electrical components.

Furthermore, in the above aspect of the present invention, when the electrical component is a capacitor, preferably, the capacitor is a multilayer film capacitor.

In this case, it is possible to reduce the height of the capacitor by using a multilayer film capacitor, which can be fabricated thinner than a common wound film capacitor. Accordingly, it is possible to reduce the height of the space between the control circuit board of the inverter and the heat-dissipating flat portion, where the capacitor is accommodated. This contributes to compact design of the integrated-inverter electric compressor.

As described above, with the integrated-inverter electric compressor according to the present invention, a dead space in the inverter box can be used effectively to achieve a compact design. Furthermore, cooling properties of heat-generating electrical components disposed on the control circuit board of the inverter can be improved, flexibility of wiring layout can be increased, and anti-vibration properties of electrical components can be improved.

DETAILED DESCRIPTION OF THE INVENTION

Hereinafter, embodiments of an integrated-inverter electric compressor according to the present invention will be described with reference to the drawings.

First Embodiment

Figure 1:
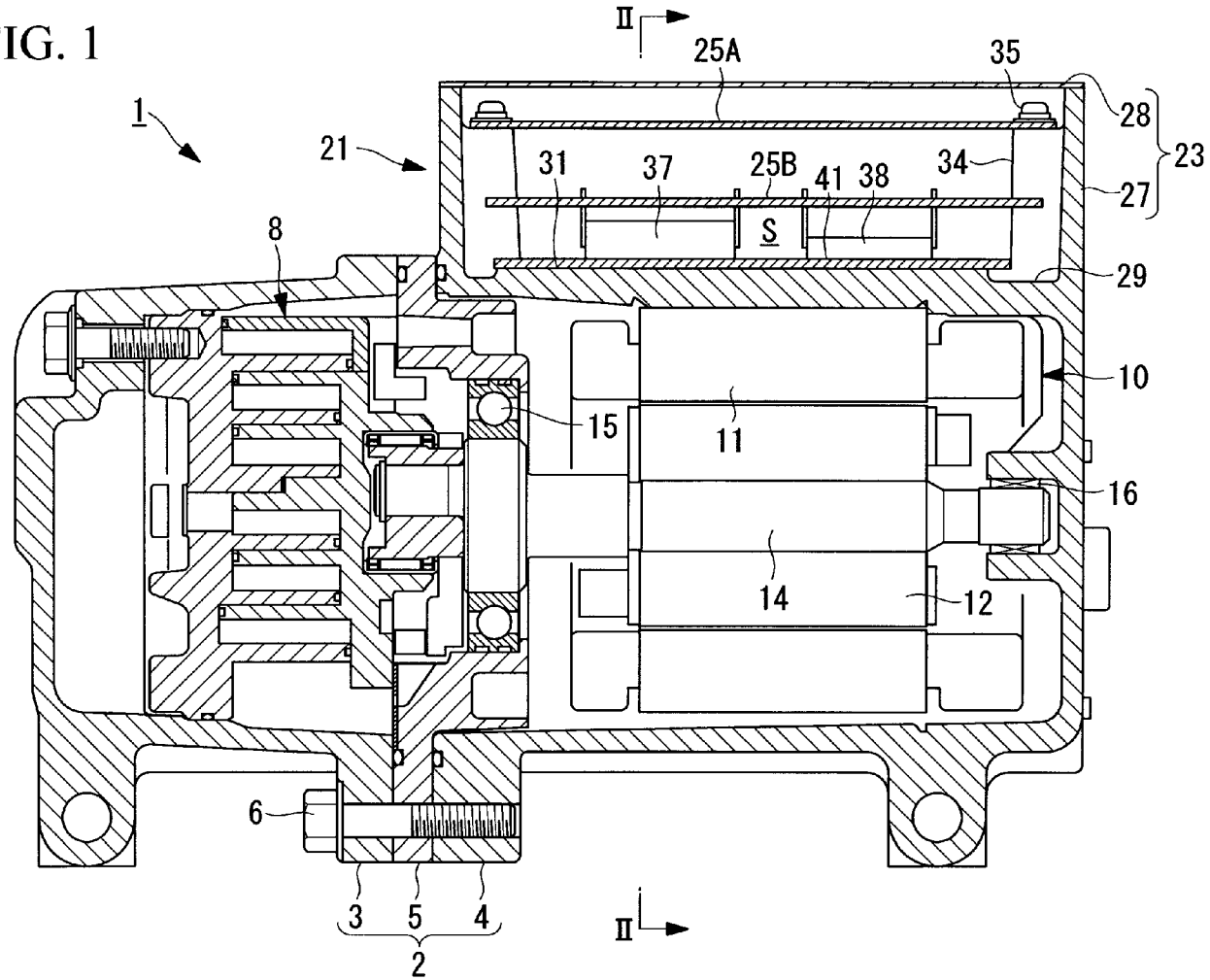
FIG. 1 is a vertical sectional view schematically illustrating the configuration of an integrated-inverter electric compressor according to a first embodiment of the present invention.

Now, a first embodiment of the present invention will be described with reference to FIGS. 1 to 6. FIG. 1 is a vertical sectional view schematically illustrating the configuration of an integrated-inverter electric compressor according to this embodiment. The integrated-inverter electric compressor 1 is a compressor used in a vehicle air conditioner, and its driving rotation speed is controlled by an inverter.

The integrated-inverter electric compressor 1 has a housing 2 made of an aluminum alloy and constituting a case thereof. The housing 2 is constructed by fastening together a compressor-side housing 3 and an electric-motor-side housing 4 with a bearing housing 5 in between by using bolts 6.

Inside the compressor-side housing 3, a known scroll compressor 8 is installed. Inside the electric-motor-side housing 4, a stator 11 and a rotor 12 constituting an electric motor 10 are installed. The scroll compressor 8 and the electric motor 10 are linked via a main shaft 14 so that the scroll compressor 8 can be driven by rotating the electric motor 10. The main shaft 14 is rotatably supported by a main bearing 15 held by the bearing housing 5 and a sub-bearing 16 held at an end of the electric-motor-side housing 4.

At the end of the electric-motor-side housing 4, a refrigerant intake opening (not shown) is provided. The refrigerant intake opening is connected to an intake duct of the refrigeration cycle so that low-pressure refrigerant gas can be taken into the interior of the electric-motor-side housing 4. The refrigerant gas circulates through the interior of the electric-motor-side housing 4 to cool the electric motor 10 and is then taken into the scroll compressor 8, where the refrigerant gas is compressed to become high-temperature, high-pressure refrigerant gas, and this refrigerant gas is discharged to a discharge duct of the refrigeration cycle from a discharge opening (not shown) provided at an end of the compressor-side housing 3.

The electric motor 10 is driven via an inverter 21, and its rotation speed can be controlled to vary in accordance with the air-conditioning load. The inverter 21 is implemented by, for example, a plurality of control circuit boards, in this case, an upper board 25A and a lower board 25B, vertically overlapping each other and accommodated inside an inverter box 23 formed integrally at the periphery of the housing 2 and having a rectangular shape in plan view, so that the inverter 21 is integrated with the integrated-inverter electric compressor 1. The inverter 21 is electrically connected to the electric motor 10 via an inverter output terminal, a lead, a motor terminal, etc. (not shown).

Figure 2:
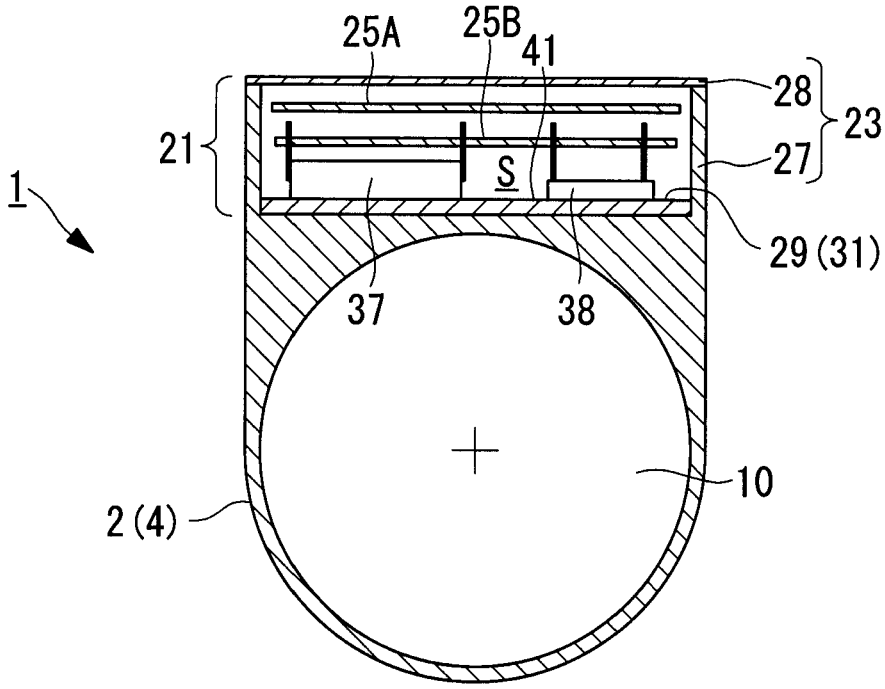
FIG. 2 is a vertical sectional view taken along a line II-II in FIG. 1.

As shown in FIGS. 1 and 2, the inverter box 23 has a structure in which, for example, a peripheral wall 27 is formed integrally at an upper part of the electric-motor-side housing 4 and an opening thereof is covered by a lid 28 in a watertight manner. The depth of the inverter box 23 is determined such that the upper board 25A and the lower board 25B constituting the inverter 21 can be accommodated inside with a predetermined vertical space therebetween. A bottom face 29 of the inverter box 23 constitutes an outer wall of the electric-motor-side housing 4, where a heat-dissipating flat portion 31 is formed parallel to the upper board 25A, the lower board 25B, and the lid 28.

For example, the upper board 25A is fastened via screws 35 to board fastening bosses 34 formed at the four corners of the inverter box 23. The lower board 25B is fixed inside the inverter box 23 by one of various fixing mechanisms described later, and a space S is formed between the lower board 25B and the heat-dissipating flat portion 31. Here, for example, the upper board 25A is a CPU board having thereon elements that operate at low voltage, such as a CPU, and the lower board 25B is a power board having thereon heat-generating elements, such as a smoothing capacitor 37 and a power module 38. In this embodiment, as components of the inverter 21, only the upper board 25A and the lower board 25B are shown, and other devices are omitted.

Figure 3:
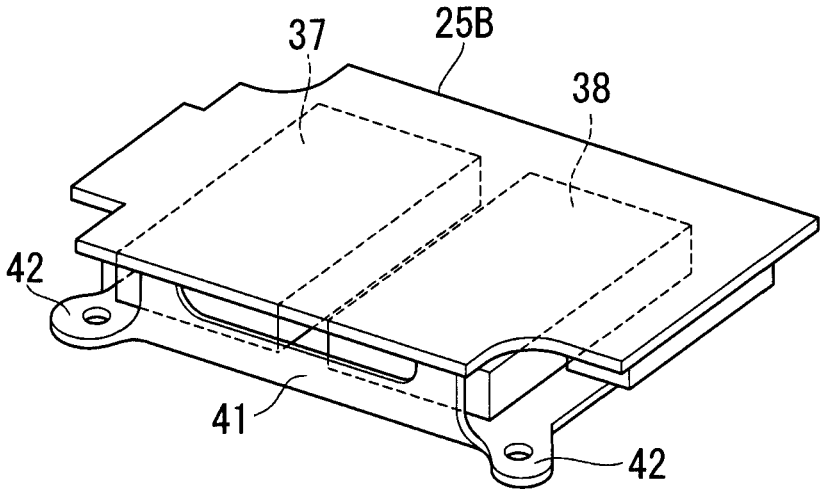
FIG. 3 is a perspective view of a control circuit board constituting an inverter and a heat-conducting member.

For example, a plate-shaped heat-conducting member 41 formed of a material having good heat conductivity, such as an aluminum alloy, is laid on a part or the entirety of the bottom face 29 of the inverter box 23 by using fixing ways such as bonding or screwing, and the heat-conducting member 41 abuts against the electric-motor-side housing 4, which is formed of an aluminum alloy. As shown in FIG. 3, the lower board 25B having the smoothing capacitor 37, the power module 38, etc. mounted thereon may be fixed to the heat-conducting member 41 to form an integrated unit. Fastening parts 42 are formed on the heat-conducting member 41 for fastening the heat-conducting member 41 to the heat-dissipating flat portion 31 via bolts.

FIG. 1 shows an example where the smoothing capacitor 37 and the power module 38 are arrayed along the axial direction of the main shaft 14 of the integrated-inverter electric compressor 1. FIG. 2 shows an example where the smoothing capacitor 37 and the power module 38 are arrayed along the direction of a diameter of the integrated-inverter electric compressor 1. There is no limitation to the layout of these devices.

Figure 4:
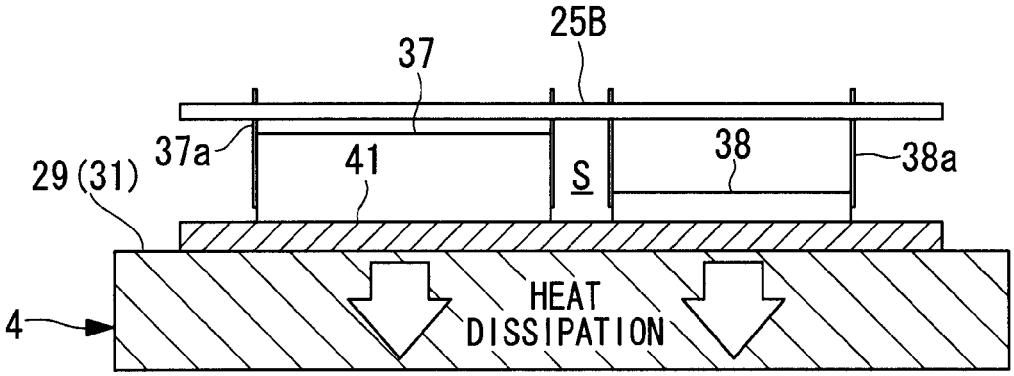
FIG. 4 is a vertical sectional view illustrating the vicinity of the control circuit board in the first embodiment of the present invention.

Electrical components such as the smoothing capacitor 37 and the power module 38 are mounted on the bottom side of the lower board 25B, and, as shown enlarged in FIG. 4, lead terminals (pin terminals) 37*a* and 38*a* of the individual components are connected to the lower board 25B. That is, the individual electrical components 37 and 38 are disposed in the space S formed between the lower board 25B and the heat-dissipating flat portion 31 (the heat-conducting member 41). Furthermore, the electrical components 37 and 38 are disposed so that the back faces thereof abut against the heat-dissipating flat portion 31 via the heat-conducting member 41. Alternatively, the electrical components 37 and 38 may be disposed so as to abut against the heat-dissipating flat portion 31 directly without the heat-conducting member 41 in The power module 38 is an electrical component, which has a smaller height (is thinner) compared with the smoothing capacitor 37. Accordingly, the lead terminal 38*a* has a greater length than the lead terminal 37*a*, and the smoothing capacitor 37 and the power module 38 are mounted at different heights on the lower board 25B. Thus, the heights of the back faces of the two electrical components 37 and 38 having different heights coincide, so that the electrical components 37 and 38 uniformly abut against the heat-conducting member 41 (or the heat-dissipating flat portion 31).

Figure 5:
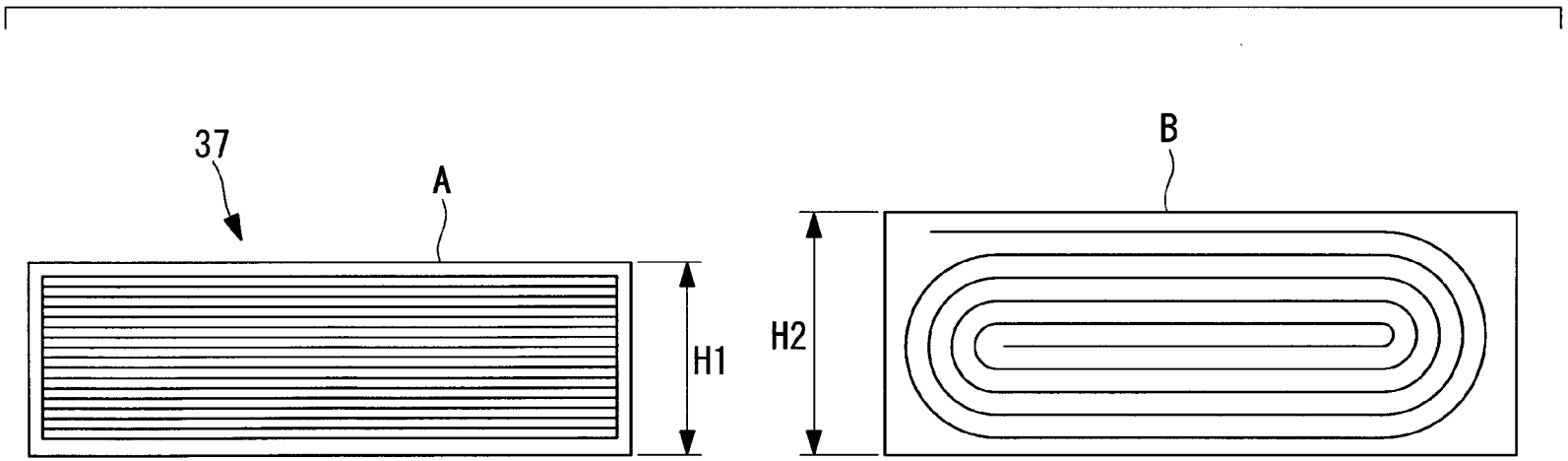
FIG. 5 is a vertical sectional view of a multilayer film capacitor and a wound film capacitor.

It is preferable to use a multilayer film capacitor as the smoothing capacitor 37. As shown in FIG. 5, it is possible to fabricate a multilayer film capacitor A with a height H1 considerably lower than a height H2 of a common wound film capacitor B. Therefore, assuming the same electrical capacitance, it is possible to reduce the height of the smoothing capacitor 37, and this makes it possible to reduce the height of the space S between the lower board 25B and the heat-dissipating flat portion 31, where the smoothing capacitor 37 is accommodated.

As shown in FIGS. 6A to 6D, the layout of the smoothing capacitor 37 and the power module 38 on the lower board 25B can be determined relatively flexibly. In the cases shown in FIGS. 6A and 6B, the smoothing capacitor 37 and the power module 38 are disposed at the front and rear, respectively, along the direction of the main shaft of the integrated-inverter electric compressor 1, and a power cable 45 connected to the smoothing capacitor 37 is led out from the front face or back face of the inverter box 23.

Figure 6A:
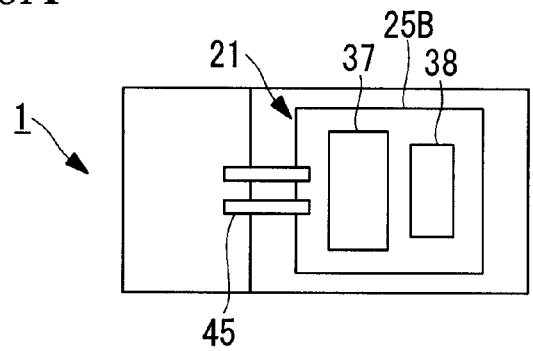
FIG. 6A is a plan view showing an example layout of electrical components on the control circuit board.
Figure 6B:
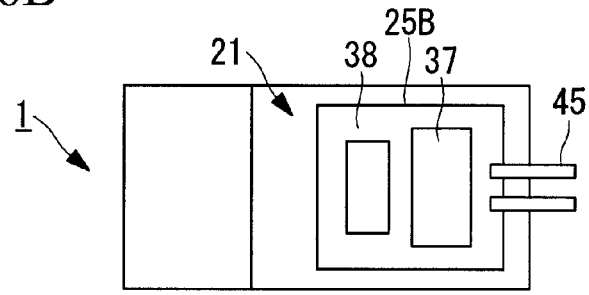
FIG. 6B is a plan view showing an example layout of electrical components on the control circuit board.
Figure 6C:
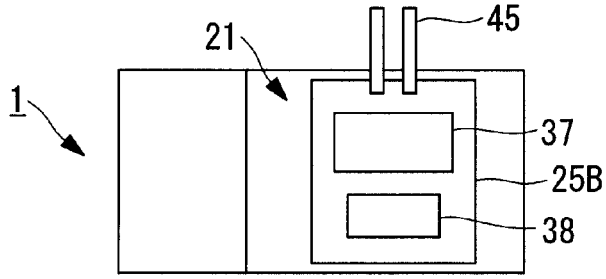
FIG. 6C is a plan view showing an example layout of electrical components on the control circuit board.
Figure 6D:
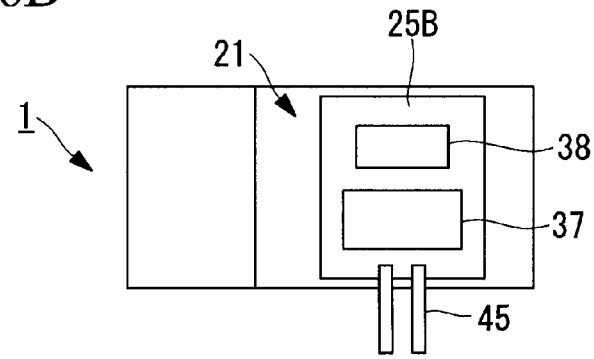
FIG. 6D is a plan view showing an example layout of electrical components on the control circuit board.

In the cases shown in FIGS. 6C and 6D, the smoothing capacitor 37 and the power module 38 are disposed side-by-side in the left-right direction of the integrated-inverter electric compressor 1, and the power cable 45 is led out from the left face or right face of the inverter box 23.

In the thus-configured integrated-inverter electric compressor 1, low-pressure refrigerant gas that has circulated through the refrigeration cycle is taken inside the electric-motor-side housing 4 via the refrigerant intake opening (not shown), circulates through the interior of the electric-motor-side housing 4, and is taken into the scroll compressor 8. The refrigerant gas is compressed by the scroll compressor 8 to become high-temperature, high-pressure refrigerant gas, and this refrigerant gas is circulated to the refrigeration cycle through the discharge duct via the discharge opening (not shown) provided at the end of the compressor-side housing 3.

In the course of this process, the low-temperature, low-pressure refrigerant gas that circulates through the interior of the electric-motor-side housing 4 exhibits an effect of absorbing heat generated by the operation of the heat-generating elements of the inverter 21, such as the smoothing capacitor 37 and the power module 38, via the heat-dissipating flat portion 31 constituting the outer wall of the electric-motor-side housing 4 and via the heat-conducting member 41 having good heat conductivity. Thus, the upper board 25A and the lower board 25B constituting the inverter 21 installed inside the inverter box 23 can be cooled forcibly.

In particular, electrical components such as the smoothing capacitor 37 and the power module 38, which are heat-generating elements mounted on the lower board 25B serving as a power board, are disposed so that their back faces abut against the heat-conducting member 41, so that heat generated through the operation of the heat-generating elements 37 and 38 is dissipated directly to the heat-dissipating flat portion 31 and the electric-motor-side housing 4 via the heat-conducting member 41. Accordingly, the lower board 25B, which is a power board and thus generates much heat, can be cooled efficiently.

For example, in the case where the interior of the inverter box 23 is filled with a gel-like plastic material, which has electrical conductivity, even if there is a space between the back faces of the smoothing capacitor 37 and the power module 38 and the heat-dissipating flat portion 31, because the space is filled with the gel-like plastic material, a similar heat-dissipating and cooling effect is achieved.

Furthermore, according to this embodiment, the smoothing capacitor 37 and the power module 38 disposed on the bottom face of the lower board 25B to constitute the inverter 21 are disposed in the space S formed between the lower board 25B and the heat-dissipating flat portion 31 formed on the outer wall of the housing 2 parallel to the lower board 25B. Thus, the dead space inside the inverter box 23 is used effectively, enabling compact construction of the integrated-inverter electric compressor 1.

In particular, in addition to using a multilayer film capacitor as the smoothing capacitor 37, since there is no space between the back faces of the smoothing capacitor 37 and the power module 38 and the heat-dissipating flat portion 31, it is possible to dispose the lower board 25B closer to the heat-dissipating flat portion 31, which makes it possible to minimize the height of the inverter box 23. In addition, since the cooling efficiency of the electrical components 37 and 38 is extremely good, it is possible to reduce the internal volume of the inverter box 23 and the capacitance of the smoothing capacitor 37, which greatly contributes to making the integrated-inverter electric compressor 1 as a whole considerably compact.

Furthermore, since a plurality of electrical components having different heights, i.e., the smoothing capacitor 37 and the power module 38, are mounted on the lower board 25B at different heights so that the back faces thereof abut against the heat-dissipating flat portion 31 either directly or via the heat-conducting member 41, the individual electrical components tightly contact the heat-conducting member 41 or the heat-dissipating flat portion 31 uniformly, so that heat can be dissipated efficiently from the individual electrical components.

Furthermore, since the smoothing capacitor 37 connected to the power cable 45 from outside can be disposed flexibly at positions on the lower board 25B, the flexibility of wiring layout can be improved considerably. Accordingly, it is possible to connect the power cable 45 to the integrated-inverter electric compressor 1 via a shortest distance without using a busbar, so that the effect of the smoothing capacitor 37 can be maximized.

Second Embodiment

Next, a second embodiment of the present invention will be described with reference to FIGS. 7 and 8.

Figure 7:
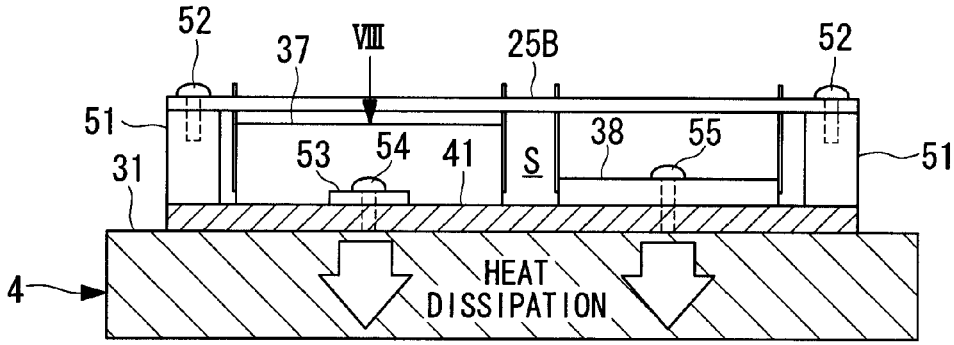
FIG. 7 is a vertical sectional view showing the vicinity of a control circuit board in a second embodiment of the present invention.
Figure 8:
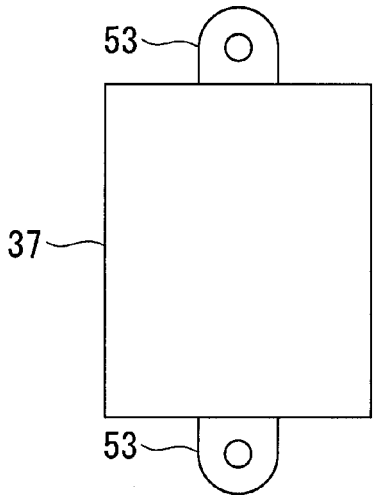
FIG. 8 is a plan view of a smoothing capacitor as viewed in the direction of an arrow VIII in FIG. 7.

In FIG. 7, parts that are configured the same as those in the first embodiment shown in FIG. 4 are designated by the same reference signs, and a description thereof will be omitted.

Also in the second embodiment, the heat-conducting member 41 is laid over the heat-dissipating flat portion 31 by using fixing parts (not shown), by bonding, or the like. Furthermore, the lower board 25B is placed on a plurality of support rods 51 located at the four corners of the heat-conducting member 41 and is fastened via screws 52. The smoothing capacitor 37 and the power module 38 mounted on the bottom face of the lower board 25B and installed in the space S formed between the lower board 25B and the heat-dissipating flat portion 31 (the heat-conducting member 41) are connected to the lower board 25B at different heights so that the heights of the back faces thereof coincide, so that the back faces of the electrical components 37 and 38 tightly contact the heat-conducting member 41. Furthermore, as shown in FIG. 8, a pair of fastening parts 53 are provided integrally on either side of the smoothing capacitor 37, and the fastening parts 53 are fastened to the heat-conducting member 41 via screws 54. Similarly, the power module 38 is also fastened to the heat-conducting member 41 via screws 55.

By fastening the lower board 25B and the electrical components mounted on the bottom face of the lower board 25B, such as the smoothing capacitor 37 and the power module 38, to the heat-conducting member 41, heat generated through the operation of the individual electrical components 37 and 38 can be dissipated efficiently to the heat-conducting member 41 and the heat-dissipating flat portion 31. Furthermore, the lower board 25B can be reliably prevented from relatively moving horizontally inside the inverter box 23 due to vibration, a lateral gravitational force, or the like.

Third Embodiment

Next, a third embodiment of the present invention will be described with reference to FIG. 9.

Figure 9:
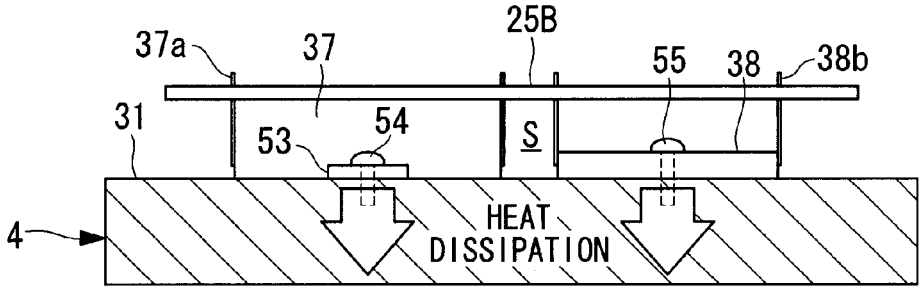
FIG. 9 is a vertical sectional view showing the vicinity of a control circuit board in a third embodiment of the present invention.

In FIG. 9, parts that are configured the same as those in the first embodiment shown in FIG. 4 are designated by the same reference signs, and a description thereof will be omitted.

In the third embodiment, although not provided here, a heat-conducting member may be laid over the heat-dissipating flat portion 31. The electrical components mounted on the bottom face of the lower board 25B, such as the smoothing capacitor 37 and the power module 38, are fastened to the heat-dissipating flat portion 31 via the fastening parts 53 and the screws 54 and 55 so that the back faces thereof tightly contact the top face of the heat-dissipating flat portion 31, resulting in improved heat dissipating properties.

The smoothing capacitor 37, which is the thicker electrical component, is installed so that its face facing the lower board 25B abuts against the bottom face of the lower board 25B. That is, the length of the lead terminal 37*a* of the smoothing capacitor 37 is shortened so that the smoothing capacitor 37 abuts against the bottom face of the lower board 25B.

In addition to omitting a heat-conducting member, since the smoothing capacitor 37, which is the thicker electrical component, is installed so that the front face and back face thereof abut against the bottom face of the lower board 25B and the top face of the heat-dissipating flat portion 31, it is possible to dispose the lower board 25B as close as possible to the heat-dissipating flat portion 31. Accordingly, it is possible to reduce the height of the inverter box 23, assisting compact implementation of the integrated-inverter electric compressor 1.

Fourth Embodiment

Figure 10:
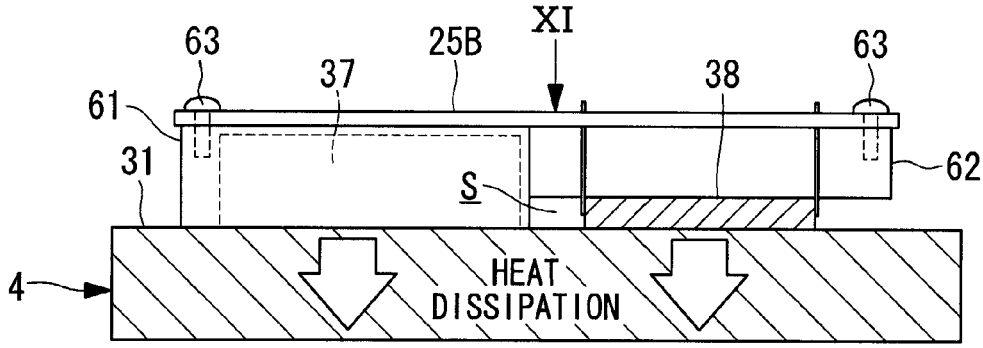
FIG. 10 is a vertical sectional view showing the vicinity of a control circuit board in a fourth embodiment of the present invention.
Figure 11:
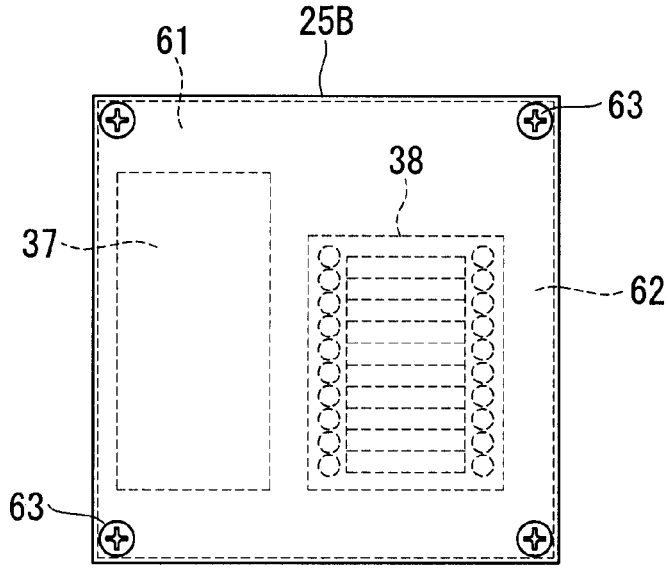
FIG. 11 is a plan view of the control circuit board as viewed in the direction of an arrow XI in FIG. 10.

Next, a fourth embodiment of the present invention will be described with reference to FIGS. 10 and 11.

Here, of the plurality of electrical components mounted on the bottom face of the lower board 25B, such as the smoothing capacitor 37 and the power module 38, the electrical component with a greater height, i.e., the smoothing capacitor 37, has an extension 62 integrally formed therewith, the extension 62 extending toward the electrical component with a smaller height, i.e., the power module 38, and overlapping the power module 38. Specifically, the extension 62 is formed integrally with a cover 61 formed of a plastic material and constituting the case of the power module 38. The extension 62 overlaps the power module 38 and presses the power module 38 toward the heat-dissipating flat portion 31. The back face of the smoothing capacitor 37 itself also abuts against the top face of the heat-dissipating flat portion 31.

The cover 61 has a rectangular shape substantially the same as the shape of the lower board 25B in plan view (see FIG. 11), and the four corners of the lower board 25B are fastened to the cover 61 via screws 63. Thus, the smoothing capacitor 37 and the power module 38 are semi-integrated with the lower board 25B via the cover 61. Heat generated through the operation of the smoothing capacitor 37 and the power module 38 is dissipated directly to the heat-dissipating flat portion 31.

With this configuration, the power module 38, which is lower, is pressed toward the heat-dissipating flat portion 31 by the extension 62 of the smoothing capacitor 37, which is higher. Thus, in particular, heat generated by the power module 38, which generates a large amount of heat, can be dissipated efficiently to the heat-dissipating flat portion 31, so that cooling properties can be improved considerably. Furthermore, by pressing the power module 38 with the extension 62, vibration (resonance) of the power module 38 can be prevented. Accordingly, anti-vibration properties can be improved, so that incorrect operation of the power module 38 can be prevented and the life can be extended.

Fifth Embodiment

Figure 12:
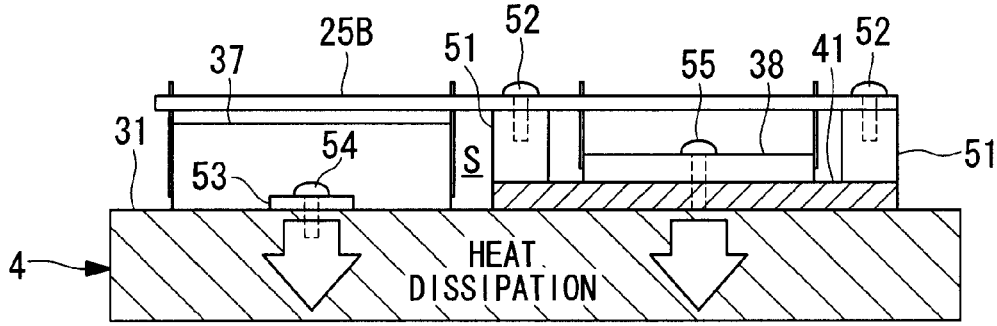
FIG. 12 is a vertical sectional view showing the vicinity of a control circuit board in a fifth embodiment of the present invention.

Next, a fifth embodiment of the present invention will be described with reference to FIG. 12.

Here, similarly to the third embodiment shown in FIG. 9, the smoothing capacitor 37 mounted on the bottom face of the lower board 25B is fastened to the heat-dissipating flat portion 31 via the fastening parts 53 and the screws 54 so that the back face thereof tightly contacts the top face of the heat-dissipating flat portion 31. Similarly, the power module 38 mounted on the bottom face of the lower board 25B is fastened to the heat-conducting member 41 via the screws 55 so that the back face thereof tightly contacts the top face of the small heat-conducting member 41 laid on the top face of the heat-dissipating flat portion 31.

On the other hand, as for the lower board 25B itself, similarly to the second embodiment shown in FIG. 7, the middle portion and the edge portion opposite the smoothing capacitor 37 are placed on top of the plurality of support rods 51 disposed on the four corners of the heat-conducting member 41 and are fastened via the screws 52. Heat generated from the smoothing capacitor 37 is dissipated directly to the heat-dissipating flat portion 31, and heat dissipated from the power module 38 is dissipated to the heat-dissipating flat portion 31 via the heat-conducting member 41.

As described above, the heat-conducting member 41 need not necessarily overlap all the electrical components mounted on the lower board 25B, and may be disposed so as to overlap only some of the electrical components. Furthermore, the support rods 51 supporting the lower board 25B need not necessarily be provided at the periphery of the lower board 25B. This serves to improve the flexibility of layout in the periphery of the lower board 25B.

Sixth Embodiment

Figure 13:
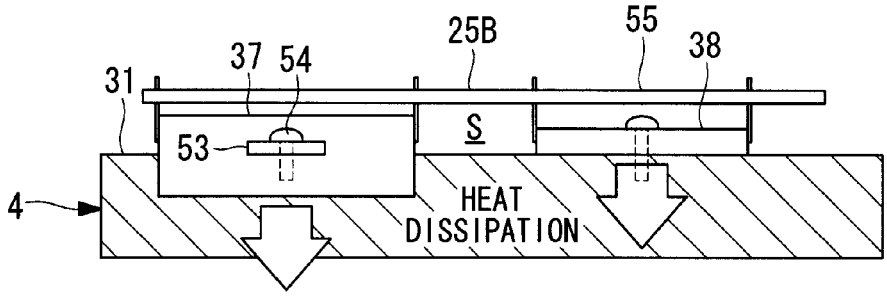
FIG. 13 is a vertical sectional view showing the vicinity of a control circuit board in a sixth embodiment of the present invention.

Next, a sixth embodiment of the present invention will be described with reference to FIG. 13.

Also in this embodiment, the smoothing capacitor 37 and the power module 38 are mounted on the bottom face of the lower board 25B, with the smoothing capacitor 37 projecting more than the power module 38 from the bottom face of the lower board 25B. On the top face of the heat-dissipating flat portion 31, a rectangular accommodating recessed part 71 is formed so that the lower half of the smoothing capacitor 37 is tightly accommodated therein. The back face of the power module 38 abuts against the top face of the heat-dissipating flat portion 31. The smoothing capacitor 37 and the power module 38 are fastened via the fastening parts 53 and the screws 54 and 55 so that the back faces thereof tightly contact the heat-dissipating flat portion 31.

With the above-described structure in which the lower half of the smoothing capacitor 37 is accommodated in the accommodating recessed part 71 formed on the top face of the heat-dissipating flat portion 31, even though the smoothing capacitor 37 considerably projects from the bottom face of the lower board 25B, it is possible to narrow the space between the lower board 25B and the heat-dissipating flat portion 31. Thus, it is possible to reduce the height of the inverter box 23, facilitating compact implementation of the integrated-inverter electric compressor 1. Furthermore, compared with the case where the smoothing capacitor 37 simply abuts against the flat top face of the heat-dissipating flat portion 31, the smoothing capacitor 37 can contact the heat-dissipating flat portion 31 over a wider area. Accordingly, heat generated through the operation of the smoothing capacitor 37 can be dissipated efficiently to the heat-dissipating flat portion 31.

Seventh Embodiment

Figure 14:
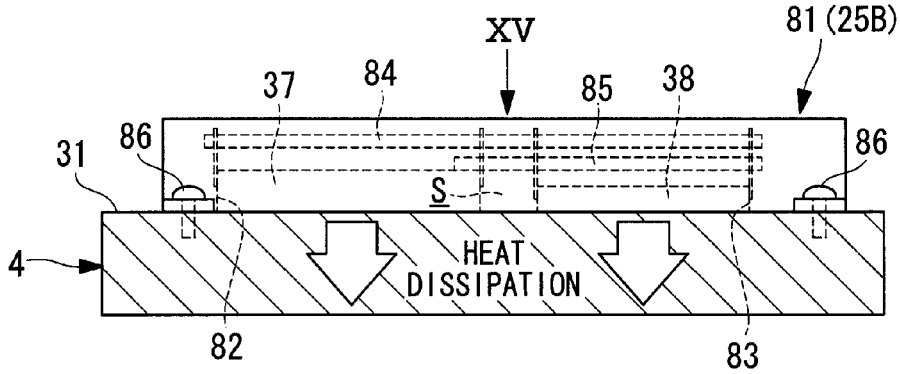
FIG. 14 is a vertical sectional view showing the vicinity of a control circuit board in a seventh embodiment of the present invention.
Figure 15:
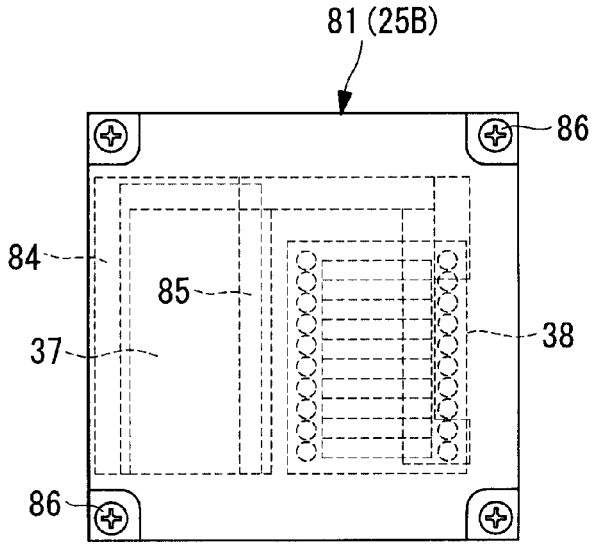
FIG. 15 is a plan view of the control circuit board as viewed in the direction of an arrow XV in FIG. 14.
Figure 16:
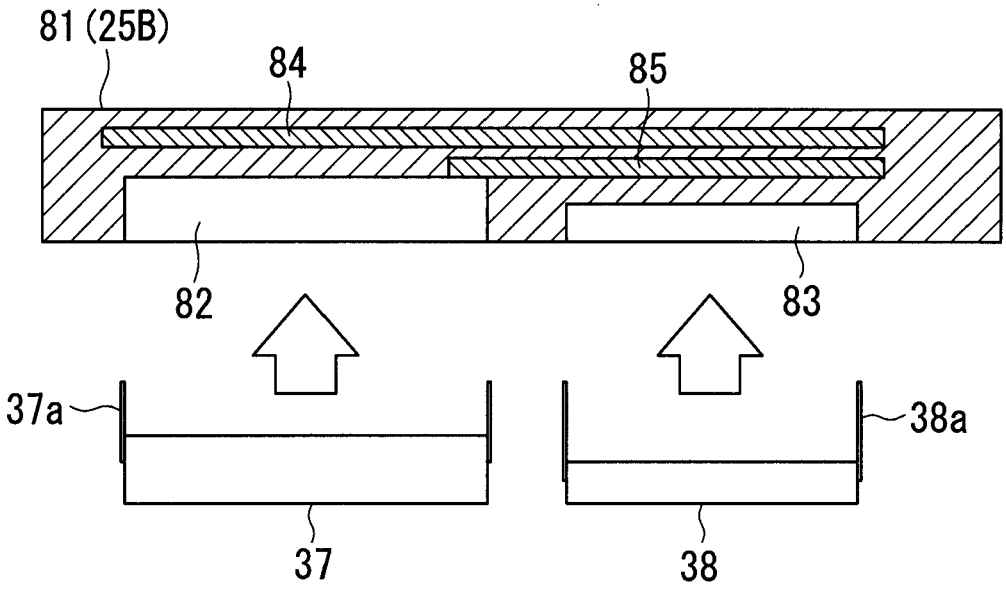
FIG. 16 is an exploded view of a cover and electrical components shown in FIG. 14.

Next, a seventh embodiment of the present invention will be described with reference to FIGS. 14 to 16.

Here, the lower board 25B is molded integrally inside a rectangular cover 81 formed of, for example, a plastic material. That is, the cover 81 itself functions as the lower board 25B. As explained in FIG. 16, a larger recessed part 82 and a smaller recessed part 83 are formed on the bottom face of the cover 81, and the smoothing capacitor 37 is engaged with the larger recessed part 82, whereas the power module 38 is engaged with the smaller recessed part 83. The back faces of the smoothing capacitor 37 and the power module 38 form a common plane with the bottom face of the cover 81, and this plane entirely abuts against the heat-dissipating flat portion 31.

At the recessed parts 82 and 83 of the cover 81, a plurality of lead-terminal insertion holes (not shown) are formed in the vicinity of the corners thereof, in which the lead terminals 37*a* and 38*a* of the smoothing capacitor 37 and the power module 38 are inserted. In the cover 81, a plurality of busbars 84 and 85 are integrally molded so as to cross each other three-dimensionally. The lead terminals 37*a* and 38*a* contact the bus bars 84 and 85 so that electricity can be supplied to the lower board 25B. The components constituting the lower board 25B, such as the busbars 84 and 85, are all disposed above the electrical components such as the smoothing capacitor 37 and the power module 38 when viewed from the side (see FIG. 14).

The cover 81 is fastened at its four corners to the top face of the heat-dissipating flat portion 31 via screws 86. Thus, the electrical components such as the smoothing capacitor 37 and the power module 38 are pressed toward the heat-dissipating flat portion 31, so that heat generated through the operation of these electrical components is dissipated to the heat-dissipating flat portion 31.

With this configuration, since the smoothing capacitor 37 and the power module 38 are covered by the cover 81 and are pressed toward the heat-dissipating flat portion 31, the cooling properties of the individual electrical components are improved. Furthermore, since resonance of the individual electrical components 37 and 38 with vehicle vibrations or the like can be inhibited, anti-vibration properties can be improved. Furthermore, with the cover 81, the waterproof properties and dust-proof properties of the individual electrical components 37 and 38 can also be improved.

It is to be understood that the present invention is not limited to the first to seventh embodiments described above. Modifications not departing from the scope of the claims are conceivable, such as suitably combining the features of the first to seventh embodiments.

What is claimed is:

1. An integrated-inverter electric compressor comprising an inverter box provided at a periphery of a housing, an inverter having a control circuit board and accommodated in the inverter box, and an electrical component mounted on one face of the control circuit board and constituting the inverter, wherein a heat-dissipating flat portion that constitutes an outer wall of the housing and that is parallel to the control circuit board of the inverter is formed in the inverter box, and the electrical component is disposed in a space between the heat-dissipating flat portion and the control circuit board, wherein a cover that covers at least one of the electrical components is provided, and the cover is fastened to the heat-dissipating flat portion so that the electrical component abuts against the heat-dissipating flat portion.

2. An integrated-inverter electric compressor according to claim 1, wherein the electrical component is installed so that a back face thereof abuts against the heat-dissipating flat portion either directly or via a heat-conducting member.

3. An integrated-inverter electric compressor according to claim 1, wherein the electrical component is installed so that a face thereof on a board side abuts against the control circuit board.

4. An integrated-inverter electric compressor according to claim 1, wherein a plurality of the electrical components having different heights are mounted on the control circuit board at different heights so that back faces of the individual electrical components abut against the heat-dissipating flat portion either directly or via a heat-conducting member.

5. An integrated-inverter electric compressor according to claim 4, wherein, of the plurality of the electrical components, an electrical component with a greater height has an extension integrally formed therewith, the extension extending toward an electrical component with a smaller height and overlapping the electrical component to press the electrical component toward the heat-dissipating flat portion.

6. An integrated-inverter electric compressor according to claim 1, wherein the electrical component is a capacitor, and the capacitor is a multilayer film capacitor.

* * * * *